United States Patent [19]

Hutchins et al.

[11] Patent Number: 4,495,992

[45] Date of Patent: Jan. 29, 1985

[54] HYDRAULIC LOGGING TECHNIQUE FOR INVERTED OIL WELLS

[75] Inventors: John S. Hutchins, Littleton; Mervyn A. DeFours, Golden, both of Colo.

[73] Assignee: Tetra Systems, Inc., Golden, Colo.

[21] Appl. No.: 511,541

[22] Filed: Jul. 6, 1983

[51] Int. Cl.[3] ..... E21B 47/00

[52] U.S. Cl. ..... 166/250; 166/65 R

[58] Field of Search ..... 166/250, 254, 255, 65 R, 166/113, 383, 385

[56] References Cited

U.S. PATENT DOCUMENTS

| | | | |
|---|---|---|---|
| 1,870,869 | 8/1932 | Ranney et al. | 299/2 |
| 3,401,749 | 9/1968 | Daniel | 166/254 |
| 3,696,332 | 10/1972 | Dickson, Jr. | 340/18 LD |
| 4,082,144 | 4/1978 | Marquis | 166/250 |
| 4,339,006 | 7/1982 | Bower, Jr. | 175/57 |
| 4,349,072 | 9/1982 | Escaron et al. | 166/250 |

*Primary Examiner*—Stephen J. Novosad
*Assistant Examiner*—William P. Neuder
*Attorney, Agent, or Firm*—W. Scott Carson

[57] ABSTRACT

A hydraulic technique for logging well holes particularly in oil mining environments where the well holes extend upwardly from mining drifts. In the technique, the logging tool is initially positioned within the well hole in a fluid-tight, sealing engagement with the well hole. The tool is connected by a flexible cable to conventional logging instruments located in the drift and to raise the tool, fluid under a first pressure is supplied below the tool within the well hole. Once raised to the desired height within the well hole, the cable is drawn downwardly raising the pressure in the fluid below the tool to a second pressure. Through a disclosed arrangement including a back pressure regulator, the pressure below the tool is maintained at the second pressure as the cable continues to be drawn downwardly. The logging tool is preferably operated as the tool is being lowered and the steady back pressure serves to provide a constant force against the downward withdrawal of the cable and tool so that the travel rate of the tool is relatively uniform. Other disclosed details of the invention include procedures and apparatuses for initially positioning the tool within the well hole and details of a fluid circuit which can be used to both raise and lower the tool.

20 Claims, 5 Drawing Figures

HYDRAULIC LOGGING TECHNIQUE FOR INVERTED OIL WELLS

FIELD OF THE INVENTION

This invention relates to the field of oil mining and more particularly to a hydraulic technique for logging inverted well holes such as used in the recovery of oil by gravity drainage techniques.

BACKGROUND OF THE INVENTION

Oil mining is an old concept dating back thousands of years. In contrast to more commonly known surface techniques for recovering oil in which wells are drilled downwardly to the oil bearing formation and the oil is then pumped up the well bore to the surface, the simplest oil mining technique (i.e., gravity drainage) involves mining tunnels under the oil bearing formation and then drilling completion holes upwardly into the oil reservoir. The oil then drains downwardly by gravity where it is collected and eventually pumped to the surface.

The term "oil mining" actually encompasses a spectrum of processes designed to free petroleum from conventionally depleted fields and from fields not otherwise workable by conventional techniques. In addition to gravity drainage, two other basic oil mining methods include extractive and capillary interchange. In extractive mining, the oil bearing rock is removed and processed in underground or surface facilities. With this method, essentially all of the in-place petroleum is recovered. However, because of high costs, it is primarily only feasible for use in reservoirs with thick and rich petroleum seams and with little or no overburden and in host environments (e.g., unconsolidated sand) where minimal processing will easily remove the petroleum. In the capillary interchange or "flip-flop" method, petroleum is recovered from shallow deposits of heavy oil and tar sand by first removing the overburden or forming a cavern above the deposit. A containment is then constructed and the partially exposed oil or tar sand deposit is flooded with a hot, high-density, saline solution. The heat from the water reduces the viscosity of the oil and the difference in specific gravities of the saline solution and petroleum cause the two to exchange positions or flip-flop. The oil migrates upwardly and is recovered from the saline solution. With this method, laboratory tests indicate that recovery will actually be effective over an area greater than the exposed portion of the deposit. As compared to the extractive mining process, none of the oil bearing sand or rock needs to be moved in the capillary interchange technique; however, as a practical matter, capillary interchange techniques are generally limited to oil recovery from heavy oil deposits within a few hundred feet of the surface.

It has been estimated that the total oil resources of the United States originally in the ground was about 450 billion barrels of which 120 have already been recovered through conventional primary and secondary techniques. Of the remaining 330 billion barrels, it is believed that 30 can still be recovered by such conventional techniques leaving 300 billion barrels still within the ground. Using oil mining techniques, it is further estimated that two-thirds of this remaining oil or 200 billion barrels could be produced which is more than all the oil that has been recovered in the United States since the first well was drilled in 1859 by Colonel Drake.

Of the three oil mining methods, gravity drainage is the simplest and potentially most effective process for recovering petroleum from conventionally depleted fields. Although general gravity drainage techniques have been used for thousands of years, little if any significant advances have been made in such fundamental areas as mine configuration (e.g., tunnel or drift layout and design) and logging techniques specially adapted to meet the needs and requirements of oil mining by gravity drainage. Rather, the trend has been to try to use conventional mining configurations and logging techniques yet such teachings are often unsuited or at cross-purposes to oil mining. For example, literally all logging techniques use a flexible cable working against gravity to lower and raise a logging tool within the well hole; however, such gravity techniques are for the most part totally unsuited for use in upwardly extending holes. As another example, conventional mining configurations generally have as their primary purpose to remove as much of the ore or rock as possible while leaving as little in place for support as is practical. In contrast, a mining configuration for oil recovery by gravity drainage would preferably remove as little rock as possible with the minimum amount of linear tunnel feet for developmental speed and efficiency while creating as much drilling surface area and room as possible for upward drilling, completion, and oil production facilities.

It was with the above in mind that the hydraulic logging technique of the present invention was developed. With it, upwardly extending or inverted well holes can be effectively and efficiently logged for the subsequent recovery of oil by gravity drainage. Additionally, the travel of other tools within the inverted well hole such as perforating and fishing tools and bottom hole chokes can be monitored and controlled with the technique for proper and effective operation of the tools.

SUMMARY OF THE INVENTION

This invention involves a hydraulic technique for raising and lowering tools such as logging tools within inverted well holes in a controlled and monitored manner. The technique is primarily intended for use in oil mining environments where the well holes extend upwardly from mining drifts. In the technique, the tool (e.g., logging tool) is initially positioned within the well hole in a fluid-tight, sealing engagement with the well hole. The tool is connected by a flexible cable to conventional logging instruments located in the drift and to raise the tool, fluid under a first pressure is supplied below the tool within the well hole. As the tool rises, its position is monitored by an odometer running on the cable. Once raised to the desired height within the well hole, the cable is drawn downwardly raising the pressure in the fluid below the tool to a second pressure. Through a disclosed arrangement including a back pressure regulator, the pressure below the tool is maintained at the second pressure as the cable continues to be drawn downwardly. The logging tool is preferably operated as the tool is being lowered and the steady back pressure serves to provide a constant force against the downward withdrawal of the cable and tool so that the travel rate of the tool is relatively uniform. Other disclosed details of the invention include procedures and apparatuses for initially positioning the tool within the well hole and details of a fluid circuit which can be used to both raise and lower the tool.

DETAILED DESCRIPTION OF THE PREFERRED EMBODIMENTS

Figure 1:
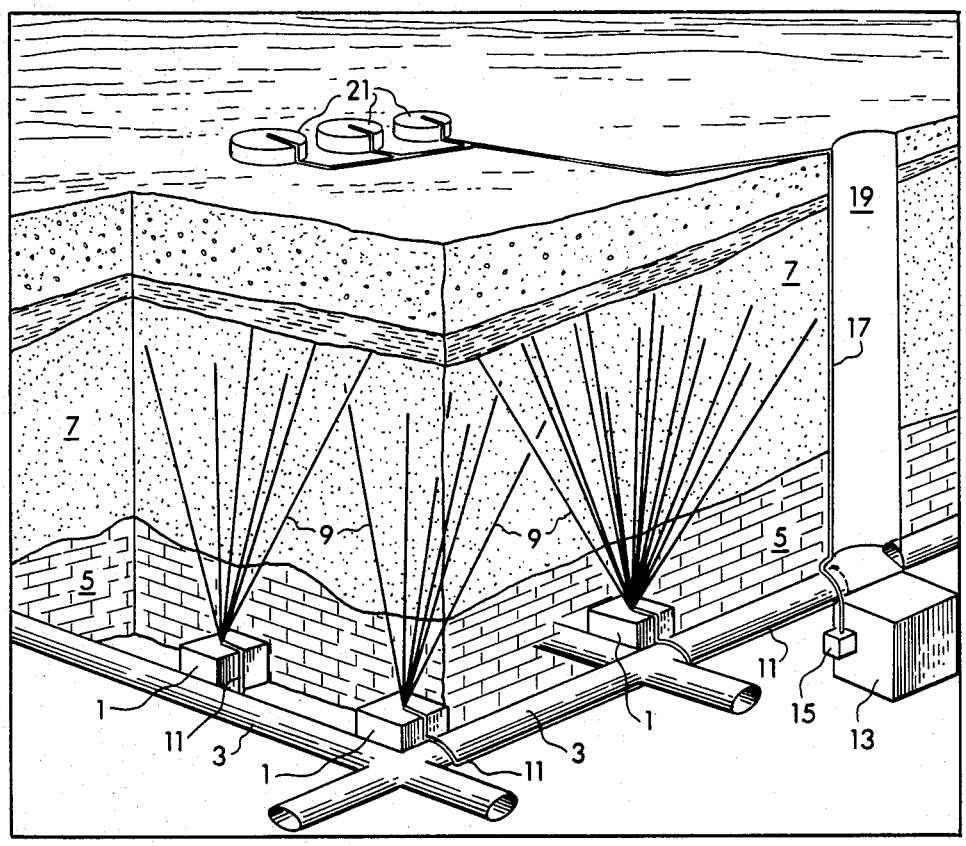
FIG. 1 is a view of an oil mining operation by gravity drainage with inverted well holes in which the disclosed hydraulic logging technique is suitable for use.

FIG. 1 illustrates an oil mining operation by gravity drainage in which the hydraulic logging technique of the present invention is suitable for use. In this oil mining operation, a plurality of drill rooms or drifts 1 are mined from the main tunnels 3 which preferably extend in the subsurface stratum 5 beneath the oil bearing formation 7. Inverted well holes 9 extend upwardly from the drifts 1 into the overlying oil bearing formation 7 and once the wells 9 are completed, oil drains by gravity down the wells 9 into pipes 11 where it flows into collection tank 13. The collected oil is then pumped from the tank 13 by pump 15 up the pipe 17 within the shaft 19 to the surface tanks 21.

Figure 3:
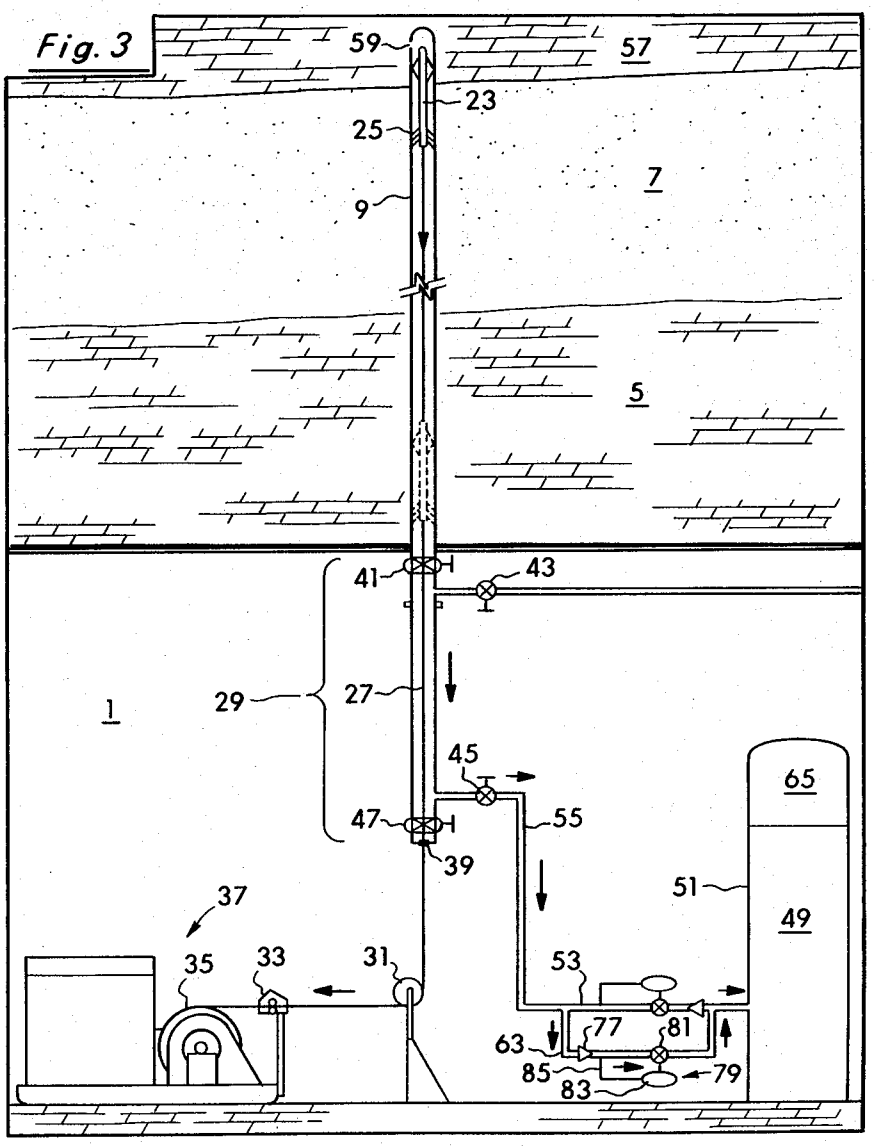
FIG. 3 is a view similar to FIG. 2 illustrating the manner in which the logging tool is lowered according to the disclosed technique in a controlled and monitored manner. The actual logging by the logging tool is preferably done during the steps shown in FIG. 3.
Figure 2:
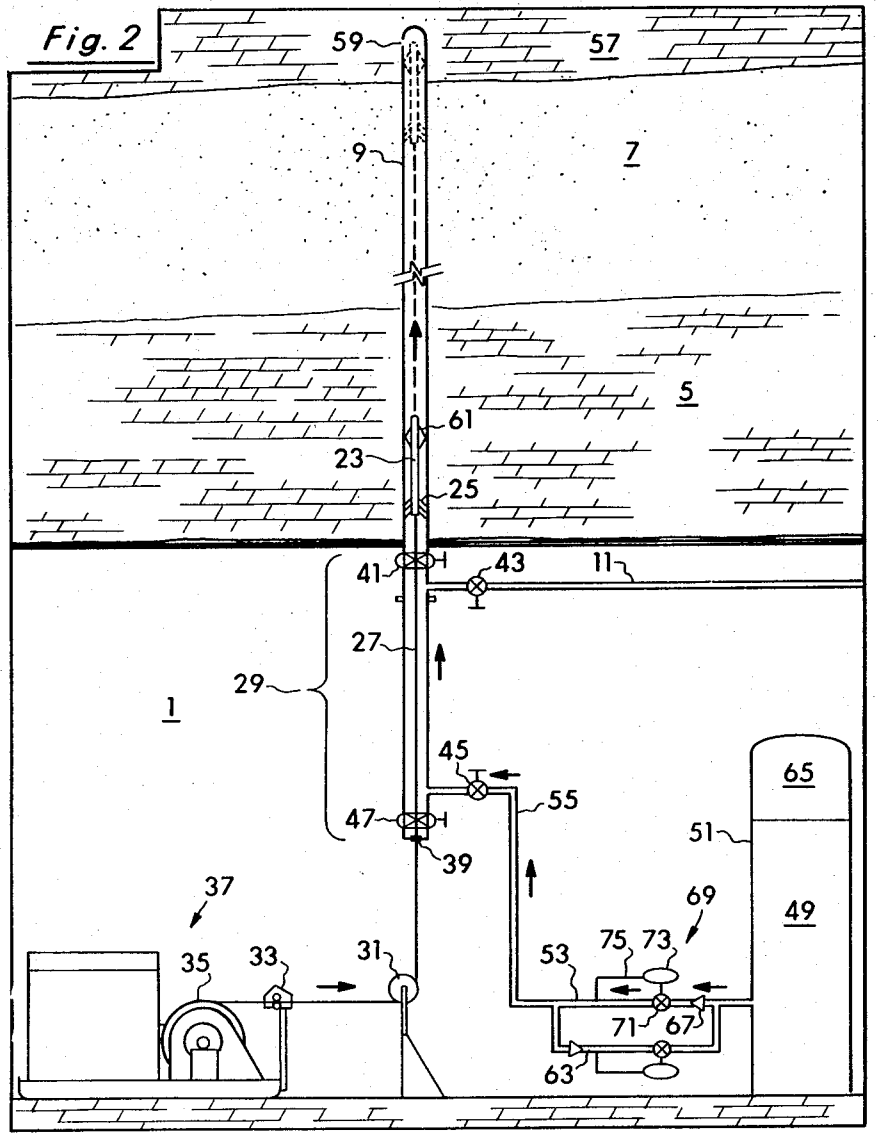
FIG. 2 is a cross-sectional view of an inverted well hole extending upwardly from a mining drift illustrating the relative positioning of the logging tool within the well hole and the manner in which it is raised by hydraulic pressure to the top of the well hole.
Figure 4:
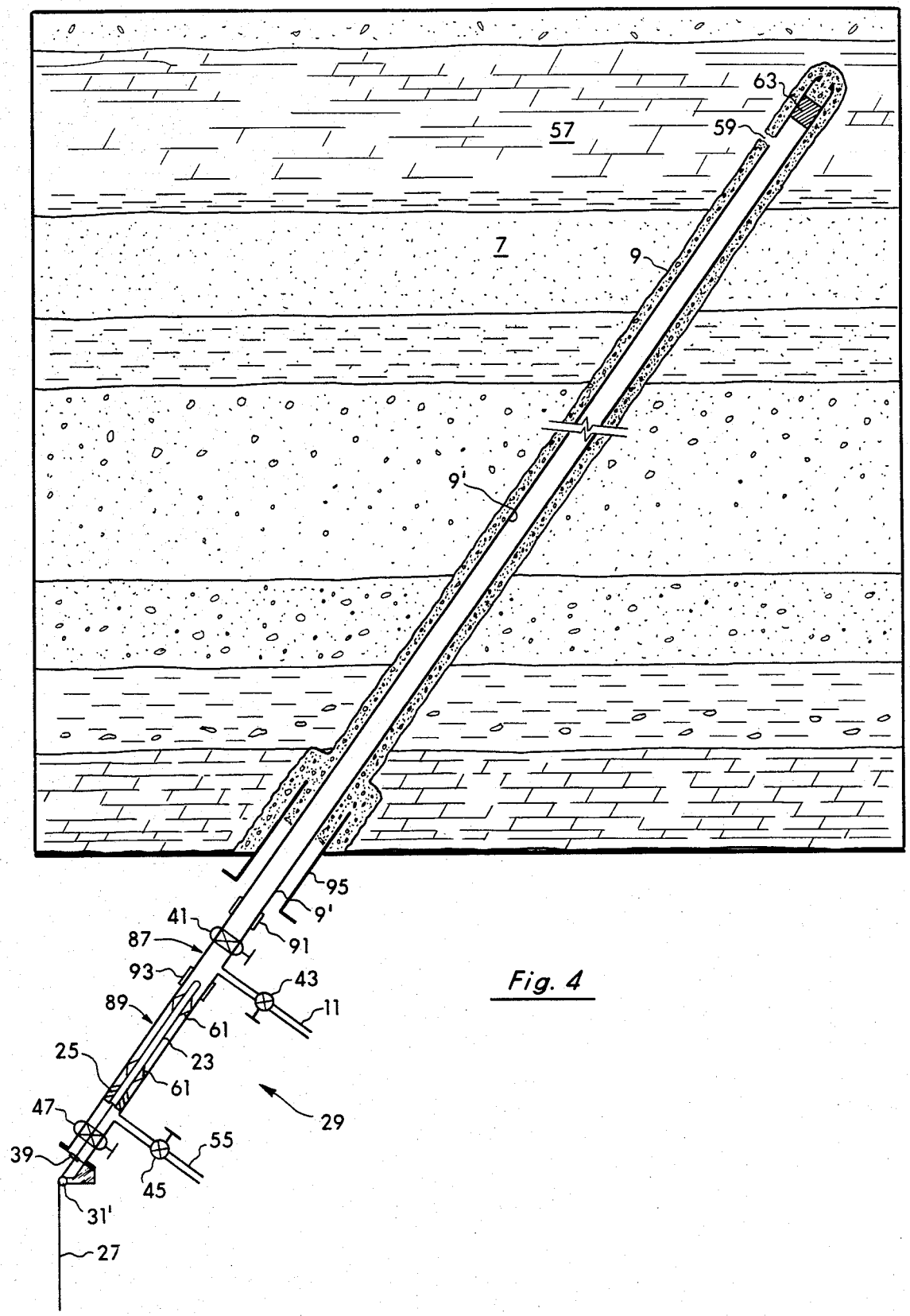
FIG. 4 is a cross-sectional view showing the apparatus used to perform the disclosed method in an inverted well hole which is encased and extends upwardly at an inclined angle from the horizontal.

As best seen in FIGS. 2–4, a threshold problem in the oil mining operation of FIG. 1 is the logging of the inverted well holes 9; and, although the angle of the wells 9 from the horizontal can vary widely (see FIGS. 2 and 4), the logging technique of the present invention offers procedures and apparatus suitable for use regardless of the well's inclination. More specifically and referring to the vertically extending well 9 of FIGS. 2 and 3, the technique involves initially positioning the logging tool 23 within the well hole 9 (FIG. 2) adjacent the interface between substratum 5 and drift 1 with the rubber or chevron seals 25 engaging the well hole 9 in a fluid-tight, sealing engagement. Additionally, in this initial positioning, the flexible cable 27 attached to the tool 23 (e.g., by a cable head) extends downwardly from the tool 23 through the sealing means 29, about the transfer pulley 31, through the odometer 33, and onto the winch 35 of the recording and control unit 37. The sealing means 29 prevents the passage of fluid between the well hole 9 and drift 1 and includes a lower, fluid-tight seal at 39 for passing the cable 27 and valves 41, 43, 45, and 47. Valve 43 controls flow through the line 11 which will eventually carry the produced oil to the collection tank 13 (FIG. 1). The valve 43 is normally closed during the logging procedure while the remaining valves 41, 45, and 47 are normally open during most of the procedure.

Referring again to FIG. 2, once the logging tool 23 is initially positioned within the well hole 9, fluid 49 (e.g., oil) under a first pressure is supplied from the tank 51 through lines 53 and 55 and sealing means 29 to the well hole 9 below the chevron seal 25. This first pressure may vary but is preferably constant at a pressure (e.g., 100 psi) sufficient to overcome any fluid head (e.g., hydraulic, gas pressure) within the well hole 9 on the tool 23 and to raise the tool 23 and attached cable 27 upwardly to the position shown in dotted lines in FIG. 2. Any fluid above the logging tool 23 as it is being raised will be forced into the formations 5, 7, and 57 if the well hole 9 is not encased; however, the well hole 9 is preferably encased at this point with a top perforation 59 being provided so that any fluid above the logging tool 23 will be forced through the perforation 59 into the stratum 57 above the oil bearing formation 7 or into the oil bearing formation 7 if the perforation is at the level of the formation 7. The members 61 shown on the logging tool 23 are centralizers which help center the tool 23 and freely pass any fluid flow they encounter.

Once the logging tool 23 approaches the desired height within the well hole 9, its upward travel is halted, as for example, by operation of the winch 35 or by its encounter with the plug 63 (see FIG. 4). At this point, the cable 27 and attached logging tool 23 are drawn downwardly by operation of the winch 35 (FIG. 3) to create a second pressure in the fluid within the well hole 9 below the sealing engagement at 25 of the logging tool 23 with the well hole 9. Under the disclosed technique, the drawing of the cable 27 and attached logging tool 23 is continued downwardly while the pressure in the fluid within the well hole 9 below the sealing engagement at 25 is maintained substantially constant at the second pressure. The second pressure (e.g., 125 psi) is preferably greater than the first pressure (e.g., 100 psi) used to raise the logging tool 23. Also, the logging tool 23 is preferably operated as the tool 23 is being lowered (see FIG. 3) wherein the steady back pressure (e.g., 125 psi) serves to provide a constant force against the downward withdrawal of the cable 27 and tool 23 so that the travel rate of the cable 27 and tool 23 is relatively constant for an accurate logging. However, if desired, the downward travel of the logging tool 23 can be intermittent with the second pressure serving to hold the tool 23 in place during any stops. As with conventional logging instruments, the operational signals to and from the logging tool 23 passes through the cable 27 leading to the recording and control unit 37.

The fluid circuit for raising the logging tool 23 (FIG. 2) and maintaining a constant back pressure during lowering of the tool 23 (FIG. 3) includes tank 51, lines 53 and 55, and by-pass line 63. Tank 51 is of conventional design and employs a gas 65 (e.g., carbon dioxide, nitrogen) to maintain the oil 49 at a relatively constant pressure (e.g., 110 psi) between the first and second pressures. Line 53 (FIG. 2) has a check valve 67 and constant pressure regulator 69 in it to keep the first pressure raising the tool 23 relatively constant. The constant pressure regulator 69 includes valve 71 and diaphragm 73 with sensing line 75. In operation and with valves 45 and 41 of the sealing means 29 open and valve 43 closed (FIG. 2), oil 49 from tank 51 passes through check valve 67 and valve 71 in line 53 and on through line 55 and sealing means 29 to raise the tool 23 within the well hole 9. Line 75 from diaphragm 73 senses the pressure of the oil in line 53 downstream of valve 71 and in a known manner, the arrangement of line 75 and diaphragm 73 variably opens and closes the valve 71 to maintain the pressure substantially constant in line 53. Once the tool 23 is raised to the desired height as shown in dotted lines in FIG. 2, the cable 27 and tool 23 are drawn downwardly as shown in FIG. 3 to increase the pressure of the fluid within the well hole 9 below the tool 23 to a second pressure. This second pressure is preferably greater than the first pressure and serves to activate flow through the by-pass line 63. More specifically, the by-pass line 63 in a manner similar to line 53 has a check valve 77 and back pressure regulator 79 consisting of valve 81, diaphragm 83, and sensing line 85. The back pressure regulator 79 is set to maintain a constant pressure (e.g., 125 psi) so that once the downward draw of the cable 27 and tool 23 creates the second pressure (e.g., 125 psi) in the fluid, sensing line 85 moves the diaphragm 83 to open the valve 81 (FIG. 3) to pass fluid back into the tank 51. The back pressure regulator 79 maintains this second pressure substantially constant to provide a substantially constant force against the downward withdrawal of the cable 27 and tool 23 so that the travel rate of the tool 23 is relatively uniform.

Figure 5:
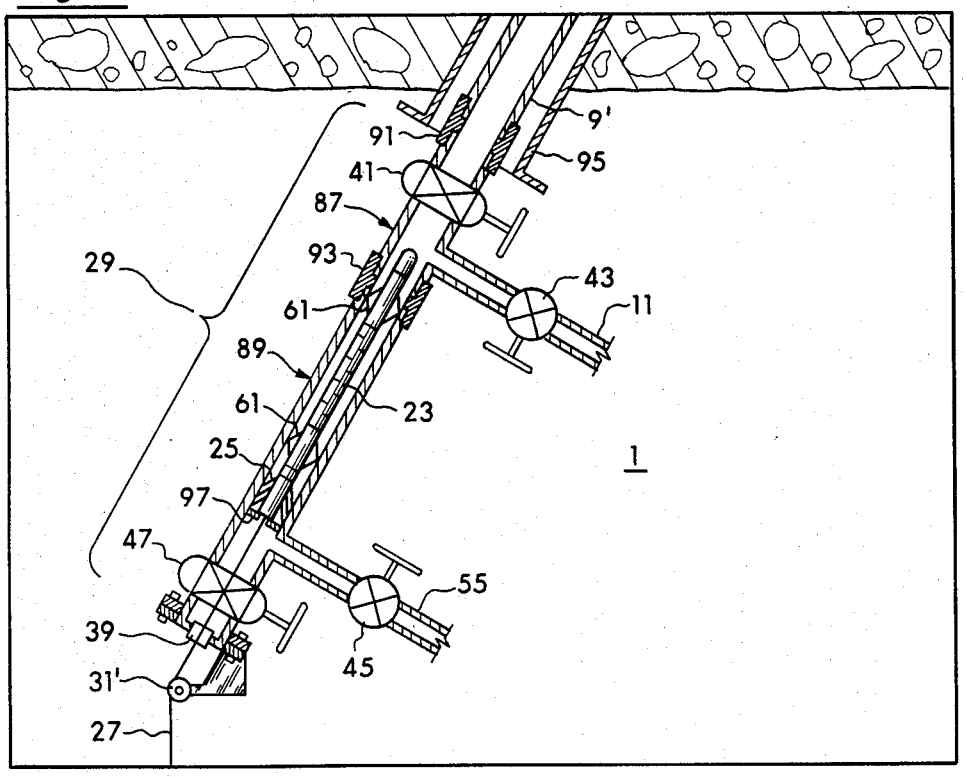
FIG. 5 is an enlarged view of the apparatus used to seal the encased well hole from the main drift, initially position the logging tool within the well hole, and guide fluid under pressure to raise and lower the tool within the well hole.

The logging tool 23 can be initially positioned in the well hole 9 as shown in FIG. 2 in a number of ways but is preferably so positioned hydraulically. More specifically and referring to FIGS. 4 and 5, the sealing means 29 which separates the well hole 9 from the drift 1 and prevents the passage of fluid therebetween includes a first portion 87 and a second portion 89. The first portion 87 is removably secured at 91 to the casing 9' of well hole 9 (see FIG. 4) and the second portion 89 is removably secured at 93 to the first portion 87. If the well hole 9 is not encased or only has a well head casing 95, then the first portion 87 can be secured directly to either if desired. In operation to initially position the logging tool 23 in the encased well hole 9' as best seen in FIG. 5, the first portion 87 of the sealing means 29 is secured at 91 to the well hole casing 9' with the valve means 41 and 43 closed. The logging tool 23 is then inserted in the free, second portion 89 of the sealing means 29 with the flexible cable 27 passing through the seal 39 at one end section of 89. Once in place with the logging tool 23 abutting the spacing elements 97, the second portion 89 at the other end section is secured at 93 to the first portion 87 whereupon valves 41 and 45 are opened and fluid under the first pressure in line 55 advances the logging tool 23 upwardly into the well hole to the position shown in solid lines in FIG. 2. To remove the logging tool 23 after the well hole 9 has been logged, the procedure is essentially reversed wherein the valves 41 and 45 are closed and the second portion 89 is removed from the first portion 87. If desired, a perforating tool can then be exchanged for the logging tool 23 and raised up the well hole 9 in the same manner with the odometer 33 of the recording and control unit 37 monitoring the length of cable within the well hole 9 as it did with the logging tool 23. Once the well hole is perforated at the desired location along the oil bearing formation 7 and the perforating tool withdrawn to the position of FIG. 5, valve 41 can be closed, the second portion 89 removed and replaced with a plug, and valves 41 and 43 opened to place the well hole 9 in fluid communication with line 11 leading to the collection tank 13 (FIG. 1) and eventually to the surface tanks 21. The valve 47 shown as part of the sealing means 29 does not perform an active role in the preferred embodiment of the invention and can be left open or closed if desired, for example, to make adjustments to or replace the lower seal 39. Also, additional transfer pulleys such as 31' as shown in FIGS. 4 and 5 can be added as needed to direct the travel of the flexible cable 27 for proper tensioning and wire line calibration by the odometer 33.

While several embodiments of the present invention have been described in detail herein, it is understood that various changes and modifications can be made without departing from the scope of the invention.

We claim:

1. A method for raising and lowering a tool such as a logging tool within a well hole extending upwardly from a mining drift, said well hole being separated from said drift by sealing means to prevent the passage of fluid therebetween, said tool having a flexible cable attached thereto and passable through a substantially fluid-tight seal in said sealing means, said tool further having means for engaging said well hole in a substantially fluid-tight, sealing engagement, said method including the steps of:

(a) positioning said tool within said well hole in said fluid-tight, sealing engagement with said well hole with said flexible cable attached thereto passing through said fluid-tight seal in said sealing means, (b) supplying fluid under a first pressure to said well hole below said sealing engagement of said tool therewith, said first pressure being sufficient to overcome any fluid head within said well hole on said tool and to raise said tool and attached cable upwardly within said well bore, (c) halting the upward travel of said tool and attached cable within said well hole, (d) drawing the cable and attached tool downwardly to create a second pressure in the fluid within said well hole below said sealing engagement of said tool therewith, (e) continuing to draw said cable and attached tool downwardly, and (f) maintaining the pressure in the fluid within said well hole below said sealing engagement of said tool therewith substantially constant at said second pressure during step (e).

2. The method of claim 1 wherein said first pressure of step (b) is substantially constant.

3. The method of claim 1 wherein said second pressure is different from said first pressure.

4. The method of claim 3 wherein said second pressure is greater than said first pressure.

5. The method of claim 1 wherein said first pressure is substantially constant and said second pressure is greater than said first pressure.

6. The method of claim 1 wherein step (e) includes the further limitation of drawing said cable and attached tool downwardly at a substantially constant rate.

7. The method of claim 1 further including the step of monitoring the length of cable within said well hole.

8. The method of claim 1 wherein said tool is a logging tool and said method includes the further limitation of operating said logging tool during step (e).

9. The method of claim 1 wherein said well hole has a casing and said sealing means includes first and second portions, means for securing said first portion to said well hole casing, and means for securing said first and second portions together, said first portion further includes first valve means, said second portion has first and second end sections and said seal for passing said flexible cable is located in said second portion adjacent said second end section thereof, and step (a) further includes the limitations of (i) securing said first portion of said sealing means to said well hole casing, (ii) closing said first valve means, (iii) inserting said tool in said second portion of said sealing means with said flexible cable attached thereto passing through said seal, (iv) securing said second portion to said first portion, (v) opening said first valve means, and (vi) advancing said tool upwardly into said well hole.

10. The method of claim 9 wherein said second portion of said sealing means includes second valve means adjacent said second end section thereof and step (a)(vi) includes the further limitations of opening said second valve means and supplying fluid under pressure therethrough to advance said tool upwardly into said well hole.

11. An arrangement for raising and lowering a tool such as a logging tool within a well hole extending upwardly from a mining drift, said arrangement including:

said tool, a flexible cable, and means for attaching said cable to said tool, means for forming a substantially fluid-tight, sealing engagement between said tool and said well hole, means for sealing said well hole from said drift to prevent passage of fluid therebetween, said sealing means including a substantially fluid-tight seal for passing said flexible cable therethrough, means for positioning said tool within said well hole in said fluid-tight, sealing engagement with said well hole with said flexible cable attached thereto passing through said fluid-tight seal in said sealing means, means for supplying fluid under a first pressure to said well hole below said sealing engagement of said tool therewith, said first pressure being sufficient to overcome any fluid head within said well hole on said tool and to raise said tool and attached cable upwardly within said well bore, means for drawing the cable and attached tool downwardly to create a second pressure in the fluid within said well hole below said sealing engagement of said tool therewith, and means for maintaining the pressure in the fluid within said well hole below said sealing engagement of said tool therewith substantially constant at said second pressure as said cable and attached tool are being drawn downwardly.

12. The arrangement of claim 11 wherein said supplying means includes means for maintaining said first pressure substantially constant.

13. The arrangement of claim 11 wherein said second pressure is different from said first pressure.

14. The arrangement of claim 13 wherein said second pressure is greater than said first pressure.

15. The arrangement of claim 11 wherein said supplying means includes means for maintaining said first pressure substantially constant and said second pressure is greater than said first pressure.

16. The arrangement of claim 11 wherein said drawing means includes means for drawing said cable and attached cable downwardly at a substantially constant rate.

17. The arrangement of claim 11 further including means for monitoring the length of cable within said well hole.

18. The arrangement of claim 1 wherein said tool is a logging tool and said arrangement includes means for operating said logging tool as said drawing means draws said cable and attached tool downwardly.

19. The arrangement of claim 1 further including a well hole casing and wherein said sealing means includes first and second portions, means for securing said first portion to said well hole casing, and means for securing said first and second portions together, said first portion further includes first valve means, said second portion has first and second end sections and said seal for passing said flexible cable is located adjacent said second end section thereof whereby said tool can be positioned within said well hole by securing said first portion of said sealing means to said well hole casing, closing said first valve means, inserting said tool in said second portion of the sealing means with said flexible cable attached thereto passing through said seal, securing said second portion to said first portion, opening said first valve means, and advancing said tool upwardly into said well hole.

20. The arrangement of claim 19 wherein said second portion of said sealing means includes second valve means adjacent said second end section thereof and said supplying means includes means for supplying fluid under pressure through said second valve means to advance said tool upwardly into said well hole.

* * * * *